US007520147B2

(12) United States Patent
Poloni

(10) Patent No.: US 7,520,147 B2
(45) Date of Patent: Apr. 21, 2009

(54) ANCHORAGE DEVICE FOR FASTENING A COUNTERWEIGHT TO A WASHING MACHINE TUB

(75) Inventor: Fabio Poloni, Pordenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 623 days.

(21) Appl. No.: 11/285,443

(22) Filed: Nov. 22, 2005

(65) Prior Publication Data

US 2006/0110236 A1 May 25, 2006

(30) Foreign Application Priority Data

Nov. 23, 2004 (EP) ..... 04106021

(51) Int. Cl.
*D06F 37/26* (2006.01)

(52) U.S. Cl. ..... 68/24; 68/58

(58) Field of Classification Search ..... 68/24, 68/58

See application file for complete search history.

(56) References Cited

U.S. PATENT DOCUMENTS 2,956,684 A * 10/1960 Johnston et al. ..... 210/382
3,334,497 A * 8/1967 Waldrop ..... 68/23.3
3,580,014 A * 5/1971 Mazza ..... 68/23.1
4,423,607 A * 1/1984 Munini ..... 68/23.2
4,519,223 A * 5/1985 Wasemann ..... 68/23.5
5,211,038 A * 5/1993 Valent ..... 68/23.2
6,067,822 A * 5/2000 Heinzel et al. ..... 68/23.2

FOREIGN PATENT DOCUMENTS

EP 0 497 109 A1 8/1992
GB 2 004 305 * 3/1979
GB 2 044 298 * 10/1980

* cited by examiner

*Primary Examiner*—Frankie L Stinson
(74) *Attorney, Agent, or Firm*—Pearne & Gordon LLP

(57) ABSTRACT

Anchorage device for fastening a counterweight to a washing machine tub comprising: an hollow shell (1) in which a concrete ballast mass (2) is adapted to be poured, said shell (1) being provided with fastening housings (3), and threaded fastening means (4) adapted to cooperate with the fastening housings (3) in order to secure the shell (1) to a washing machine tub (5). The fastening housings (3) comprise expansion cavities (6) shaped so as to define an equivalent diameter (7), the threaded fastening means (4) comprise a head (8) integrally provided with a flange adapted to engage the tub (5) and a shank adapted to be screwed into the expansion cavities (6), said shank comprising a self-tapping thread portion (9) having a crest diameter (10) and a root diameter (11) and a not-threaded pin portion (12) having a pin portion diameter (13). The ratio of the root diameter (11) to the equivalent diameter (7), the ratio of the crest diameter (10) to the equivalent diameter (7) and he ratio of the pin portion diameter (13) to the equivalent diameter of said expansion cavities (6) being in predetermined range.

4 Claims, 3 Drawing Sheets

ANCHORAGE DEVICE FOR FASTENING A COUNTERWEIGHT TO A WASHING MACHINE TUB

DESCRIPTION

The present invention relates to an anchorage device for fastening a counterweight to a washing machine tub.

It is known that a ballasted tub increases the inertia force compensating for the forces to which the tub is subjected during rotation of the drum in the washing and spin phases.

Washing machines provided with ballast masses applied to the wash tub in different manners are known from the prior art.

Various forms of anchorage device tub are known. In one, the ballast is formed by a block of cement or heavy masses of material, which are fixed to the front wall of the tub of the machine by means of removable members such as screws, nuts and washers.

Furthermore, according to a further prior-art embodiment as disclose in GB 2 044 298, the ballast comprises a moulded plastic flange forming the front wall of the tub and being in the shape of a continuous grooved ring having a U-shaped cross-section profile, which is adapted to accommodate a concrete mass. The flange with the thereby applied concrete ballast is subsequently applied against the curved edge of the cylindrical mantle of the tub by means of a clamping ring which is fitted into the corresponding perimetral groove of said flange upon interposing a sealing gasket therebetween.

EP 0 497 109 describes a washing machine comprising a tub provided with portions protruding frontally from said tub, each one of said protruding portions being capable of accommodating square-shaped metal plates, through the threaded hole of which respective bolts can be inserted for fixing various ballast blocks. Each ballast block presents transversally running grooves in such a position that, when said block is applied in its seat, they fall in a line with the respective bolt so as to enable it to pass through. The free threaded end of each bolt is inserted through a washer and on the same washer is screwed a corresponding lock nut causing each single ballast block to be fasten in position.

In all these cases, however, the presence of several fastening means of various kinds render such anchorage devices complicated in its design and construction and leads to difficulties and inconveniences in assembling the tub and leads.

It must be noticed that with these types of anchorage devices of the washing machine counterweight cause the whole fixing operation of the latter to be consequently time-consuming. This is particularly unpleasant in fact, in the field of domestic appliance like washing machine, wherein there is a great demand of full automation.

A further drawback is that, when the counterweight have to be removed from the tub, which happens both when there is a need to replace a drum which has suffered damage during use of the machine and during the recovery or disposal of the machine at the end of its life for recycling the materials thereof, the operation to be implemented are relatively complicated and/or long and thus inevitably expensive.

The aim of the present invention is therefore to solve the noted problems, eliminating the drawbacks of the cited known art.

An object of the present invention is to provide an anchorage device making the counterweight fixing operation very easy and fast to be carried out.

An object of the present invention is to provide an anchorage device which allows the counterweight to be fixed to the tub by simple means which are not large in number and which are not expensive and which, when necessary, are also easily removable.

A further object of the present invention is to provide an anchorage device, which ensures an effective and reliable supporting means for the counterweight The present invention is embodied with the design and construction characteristics as essentially described and defined with particular reference to the appended claims.

Anyway, features and advantages of the present invention may be more readily understood from the description that is given below by way of a non-limiting example with reference to the accompanying drawings, in which.

Figure 1:
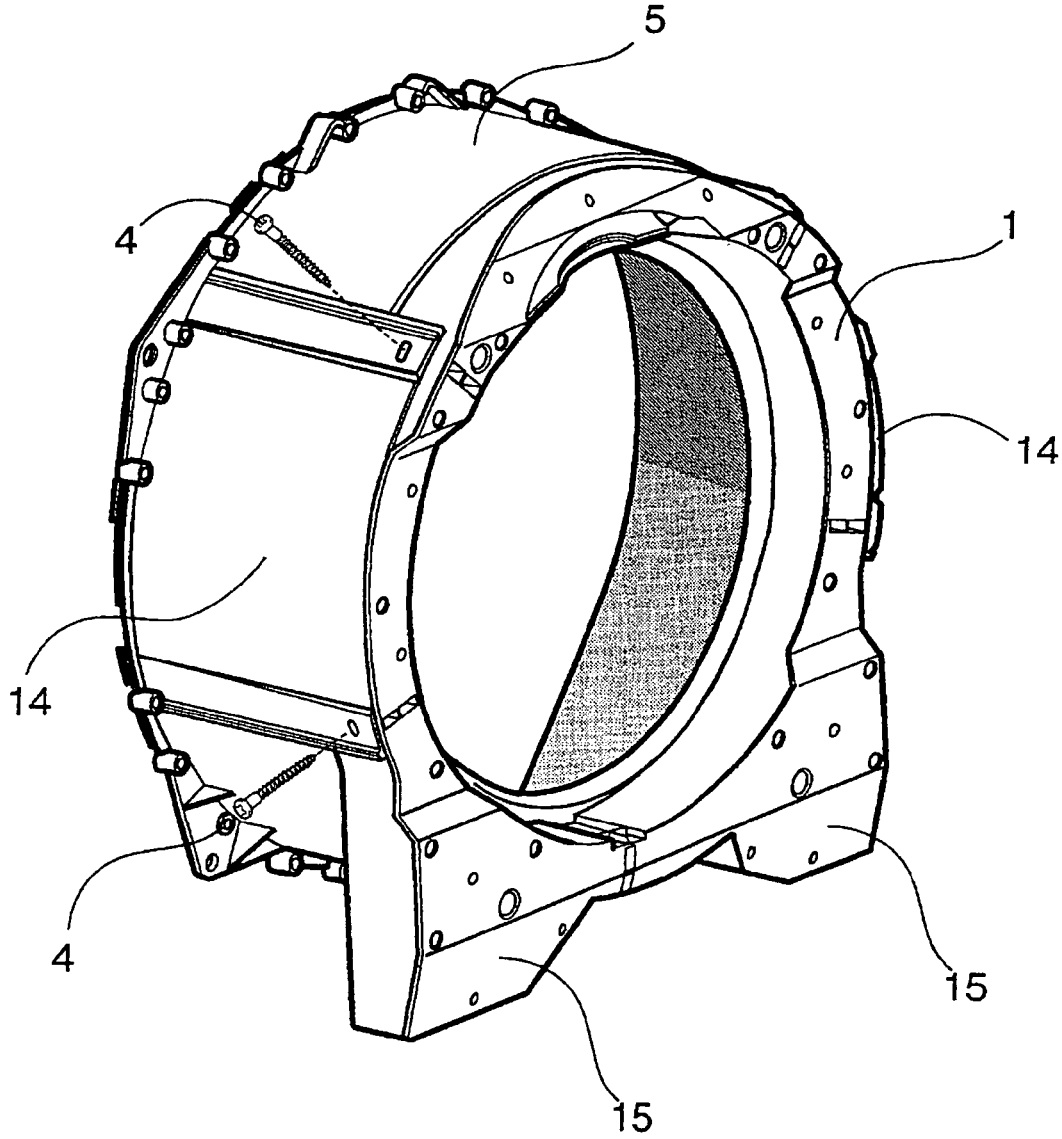
FIG. 1 is a perspective view of a washing machine tub connected to a counterweight according to the present invention.
Figure 2:
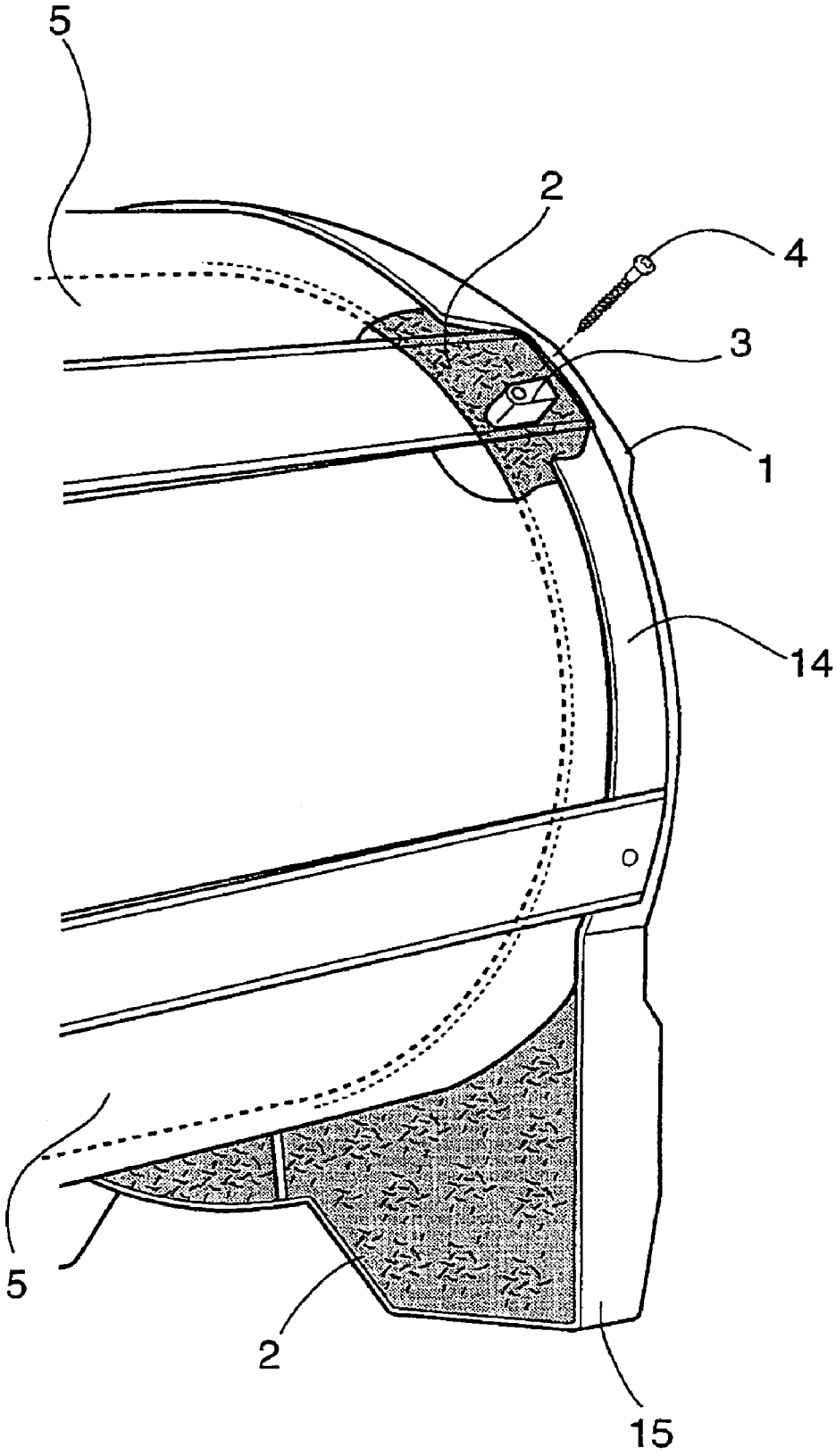
FIG. 2 is a perspective rear side view of an anchorage device according to the present invention.
Figure 3:
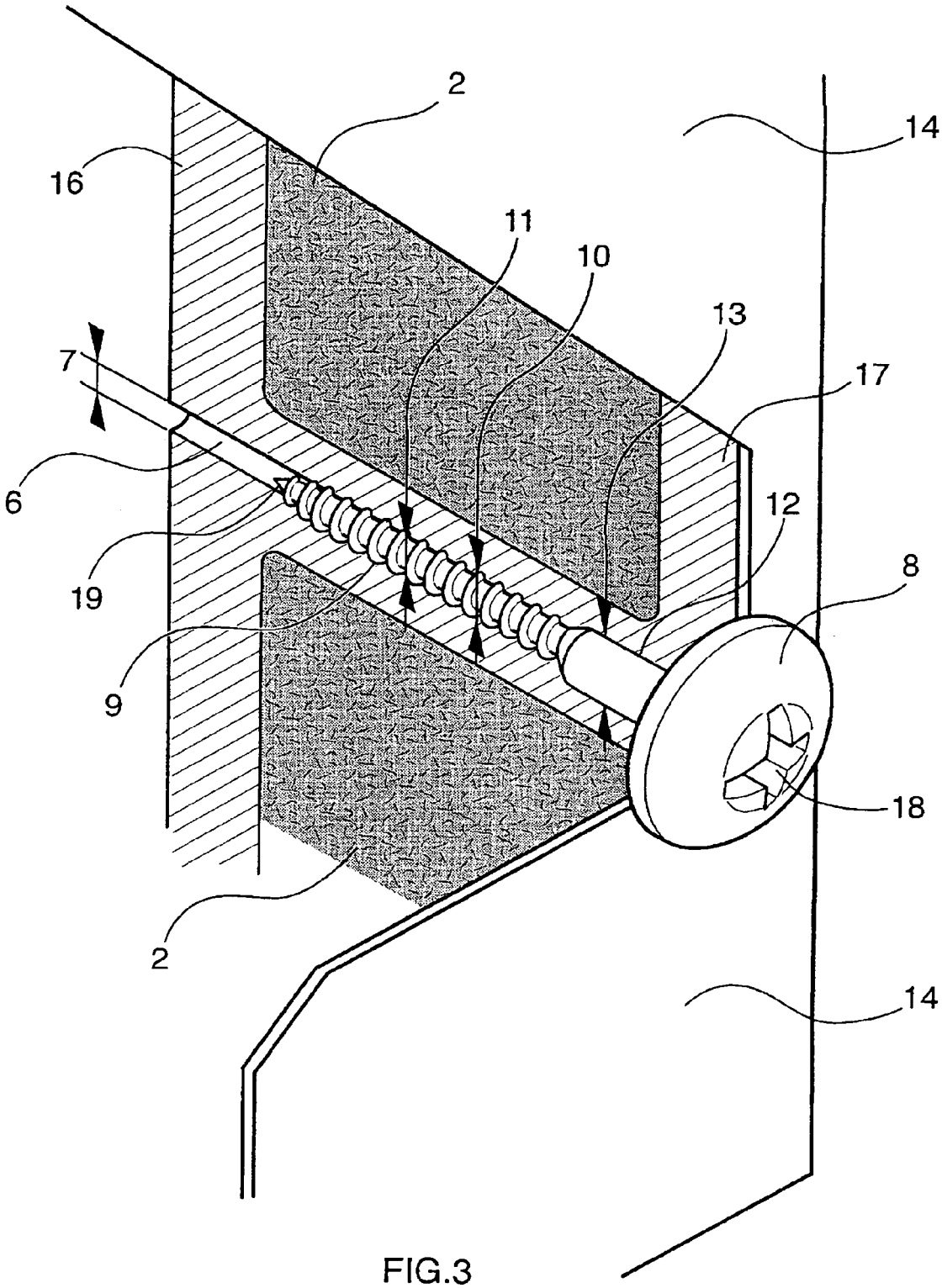
FIG. 3 is a sectional view of the anchorage device shown in FIG. 1, with an enlarged view of construction details.

With reference to the FIGS. 1 to 3, an embodiment of an anchorage device according to the present invention comprises an hollow shell 1 in which a concrete ballast mass 2 is adapted to be poured, said shell 1 being provided with fastening housings 3, and threaded fastening means 4 adapted to cooperate with said fastening housings 3 in order to secure said shell 1 to a washing machine tub 5.

The fastening housings 3 comprise expansion cavities 6 shaped so as to define an equivalent diameter 7, said threaded fastening means 4 comprise a head 8 integrally provided with a flange adapted to engage the washing machine tub 5 and a shank adapted to be screwed into said expansion cavities 6, said shank comprising a self-tapping thread portion 9 having a crest diameter 10 and a root diameter 11 and a no-threaded pin portion 12 having a pin portion diameter 13, the ratio of the root diameter 11 of the self-tapping thread portion 9 to the equivalent diameter 7 of said expansion cavities 6 being in the range of about 1 to about 1.1, the ratio of the crest diameter 10 of the self-tapping thread portion 9 to the equivalent diameter 7 of said expansion cavities 6 being in the range of about 1.1 to about 1.2, the ratio of the pin portion diameter 13 of the no-threaded pin portion 12 to the equivalent diameter 7 of expansion cavities 6 being in the range of about 1.3 to about 1.7.

In this constructive example the washing machine tub 5 formed by a cylindrical body id adapted to be installed in a front-loading washing machine and can be dosed by a front wall provided with an opening for access to the washing drum enclosed in the tub and rotating around an horizontal or inclined axis. Protruding portions 14 are provided in an annular sector shape in correspondence to the frontal part of the tub 5 so that they extend from the circumferential periphery of the tub 5 along the horizontally rotation axis of the drum in order to accommodate the counterweight arranged round the front loading opening of the tub in a manner which will be described hereinafter.

The hollow shell 1 is made of moulded plastic material forming an annular body having a U-shaped cross-section profile with downwards enlarged portions 15 for containing the concrete ballast mass 2. The annular element of the shell comprises an inner circumferential edge 16 and an exterior circumferential edge 17 of larger diameter, the shell 1 being sized so as to adapt and fit against the front part of the tub 5 and the exterior circumferential edge 17 being in a position lying underneath the protruding portions 14 of the same tub 5.

The fastening housings 3 can be integrally provided in one piece with the shell 1 or they can be provided as inserts to be incorporated in the concrete ballast mass 2 poured.

The position of the fastening housings 3 with respect to the shell 1 are such that the fastening housings 3 are arranged in correspondence to the protruding portions 14 when the shell 1 is in position to be fixed to the tub 5.

In each fastening housing 3 at least one radial expanding cavity 6 is provided open outwardly in correspondence to the exterior circumferential edge 17.

The expansion cavities 6 have a cross-section profile, which provides a surface, adapted to receive the threaded fastening means 4 due to the edgewise elastic deformation of such profile.

The expansion cavities 6 are shaped so as to form a determined cross-section with a corresponding equivalent diameter 7 which is defined as the diameter of the circle inscribed within the expansion cavities cross-section.

Such a diameter of the circle inscribed within said cross-section is hereinafter referred to as the equivalent diameter 7 of the expansion cavities 6.

The threaded fastening means 4 comprise a head 8 integrally provided with a flange and a shank adapted to be inserted in a through hole or slot provided in the protruding portions 14 of the tub 5 and to be screwed into the expansion cavities 6. The flange, on its downwardly facing underside, i.e. in the direction of the shank, is provided with projections and/or depressions in order to define self locking radial teeth adapted to effectively engage the protruding portions 14. The head 8 is provided with centrally disposed drive tool engagement recess 18.

The shank comprises a self-tapping threaded portion 9 having a tapering pointed free section 19 and a not-threaded pin portion 12, which extends from the head 8 and terminates in correspondence to a root end of the self-tapping threaded portion 9. The not-threaded pin portion 12 has substantially a smooth surface.

A major part of the shank is cylindrical the only deviation being at the pointed free section 19 where the shape is conical. The physical features of the shank are defined by a crest diameter 10 and a root diameter 11, which respectively corresponds to the outer diameter and to the inner diameter of self-tapping threaded portion 9 as it is well known in the art and by a pin portion diameter 13 which is the diameter of the not-threaded pin portion 12.

The anchorage device according to the present invention has the ratio of the root diameter 11 of the self-tapping thread portion 9 to the equivalent diameter 7 of said expansion cavities 6 being in the range of about 1 to about 1.1, the ratio of the crest diameter 10 of the self-tapping thread portion 9 to the equivalent diameter 7 of said expansion cavities 6 being in the range of about 1.1 to about 1.2, the ratio of the pin portion diameter 13 of the no-threaded pin portion 12 to the equivalent diameter 7 of said expansion cavities 6 being in the range of about 1.3 to about 1.7.

It has been found by means of empirical trials that such ranges of the ratios as defined above allow a predetermined controlled interference between the surface of expansion cavities and the shank when the screw is completely engaged so as to prevent any possible play and improve the self locking function of the screw.

The anchorage device with these determined ratios is able to ensure an effective clamping for a counterweight mass having a weight up to 25 Kg, as an example, for a washing machine spinning speed up to 1800 RPM, and for an equivalent life time of over 5000 washing cycles.

The expansion cavities 6 can be shaped in order to form a triangle or square or circular cross-section. Clearly in the case of a circular cross-section the equivalent diameter corresponds to the diameter of expansion cavities.

Triangle and square cross-sections have been found to be preferred.

In a most preferred embodiment, the fastening housing are integrally formed in one piece with the shell.

It is to be appreciated that the anchorage device can be modified so as to accomplish an axial fastening between the counterweight and the washing machine tub and not only a radial one as described in the present constructive example.

The anchorage device of the present application simplifies the fixing of the counterweight to the washing machine tub and at the same time allows the tub to be more conveniently assembled.

It can therefore be stated that the present invention provides an anchorage device in which the counterweight is fixable to the tub by means of screws and corresponding fastening housings without the need of any other fixing elements.

The present application provides an anchorage device, which allows the counterweight to be easily applicable to and also easily removable from the tub thereby doing away with the serious drawback shared by prior-art machines.

The solution proposed for the fixation of the counterweight is particularly advantageous with a view to completely automated assembly of the tub.

The anchorage device provided in this way according to the invention ensures an effective and reliable clamping means for the counterweight.

The invention claimed is:

1. Anchorage device for fastening a counterweight to a washing machine tub comprising:

an hollow shell (1) in which a concrete ballast mass (2) is adapted to be poured, said shell (1) being provided with fastening housings (3), and threaded fastening means (4) adapted to cooperate with said fastening housings (3) in order to secure said shell (1) to a washing machine tub (5), characterized in that said fastening housings (3) comprise expansion cavities (6) shaped so as to define an equivalent diameter (7), said threaded fastening means (4) comprise a head (8) integrally provided with a flange adapted to engage the tub (5) and a shank adapted to be screwed into said expansion cavities (6), said shank comprising a self tapping thread portion (9) having a crest diameter (10) and a root diameter (11) and a not-threaded pin portion (12) having a pin portion diameter (13), the ratio of the root diameter (11) of the self-tapping thread portion (9) to the equivalent diameter (7) of said expansion cavities (6) being in the range of about 1 to about 1.1, the ratio of the crest diameter (10) of the selftapping thread portion (9) to the equivalent diameter (7) of said expansion cavities (6) being in the range of about 1.1 to about 1.2, the ratio of the pin portion diameter (13) of the not-threaded pin portion (12) to the equivalent diameter of said expansion cavities (6) being in the range of about 1.3 to about 1.7.

2. Anchorage device according to claim 1, characterized in that said fastening housing (3) are integrally formed in one piece with the shell (1).

3. Anchorage device according to claim 1 or 2, characterized in that said expansion cavities (6) have a triangle cross-section profile.

4. Washing machine including an anchorage device as described in claim 1 or 2.

* * * * *